US007600947B2

(12) United States Patent
Kwon

(10) Patent No.: US 7,600,947 B2
(45) Date of Patent: Oct. 13, 2009

(54) METHOD FOR INSTALLING AN ARCH-TYPE UNDERBRACING ON A UTILITY POLE FOR AN OVERHEAD LINE BY USING EXTENDABLE EXCAVATING UNIT FOR AUGER CRANE

(75) Inventor: Sae Won Kwon, Goesan-Gun (KR)

(73) Assignee: Daewon Electric Co. Ltd., Choongchungbuk-Do (KR)

( * ) Notice: Subject to any disclaimer, the term of this patent is extended or adjusted under 35 U.S.C. 154(b) by 46 days.

(21) Appl. No.: 12/071,196

(22) Filed: Feb. 19, 2008

(65) Prior Publication Data

US 2009/0035070 A1 Feb. 5, 2009

(30) Foreign Application Priority Data

Jul. 30, 2007 (KR) ..... 10-2007-0076190

(51) Int. Cl.
*E02D 5/54* (2006.01)

(52) U.S. Cl. ..... 405/244; 405/232; 52/745.17

(58) Field of Classification Search ..... 405/231, 405/232, 244; 52/745.17, 831, 835, 834
See application file for complete search history.

(56) References Cited

U.S. PATENT DOCUMENTS 3,703,812 A * 11/1972 Newton ..... 405/244
5,984,587 A * 11/1999 Odle ..... 405/244
6,398,392 B2 * 6/2002 Gordin et al. ..... 174/45 R
6,815,607 B1 * 11/2004 Gingras ..... 174/7
2001/0018978 A1 * 9/2001 Gordin et al. ..... 174/2
2002/0007613 A1 * 1/2002 Gordin et al. ..... 52/169.13
2002/0034369 A1 * 3/2002 Forrester et al. ..... 385/134
2007/0022706 A1 * 2/2007 Fournier ..... 52/726.4

* cited by examiner

*Primary Examiner*—Frederick L Lagman
(74) *Attorney, Agent, or Firm*—GWiPS

(57) ABSTRACT

A method for installing a utility pole and arch-type underbracing has developed by using an extendable excavating unit mounted on an auger crane. The method comprises two steps of excavation that: the primary hole is excavated about 75 cm in depth by extending an arm about 80 cm diameter of the extendable excavation unit. The secondary hole is excavated to have a standard depth for erecting the utility pole. Then, orientation of the arch-type underbracing is determined for setting on the primary hole. An underbracing hook is installed to the arch-type underbracing for lifting and attaching a U-bolt temporarily to the arch-type underbracing by surround the utility pole. A lead wire of the arch-type underbracing is connected to an earth wire of the utility pole. The arch-type underbracing is tightened with the U-bolt surrounded the utility pole. The excavated soil is filling back into the gaps around the utility pole and the holes by tempering.

1 Claim, 8 Drawing Sheets

METHOD FOR INSTALLING AN ARCH-TYPE UNDERBRACING ON A UTILITY POLE FOR AN OVERHEAD LINE BY USING EXTENDABLE EXCAVATING UNIT FOR AUGER CRANE

BACKGROUND OF THE INVENTION

1. Field of the Invention

The present invention relates to a method for installing a utility pole and an arch-type underbracing by using an extendable excavating unit mounted on an auger crane, more particularly, two steps of excavation process is carried out for a excavating point to erect the utility pole and install the arch-type underbracing under the ground at a same time at the construction site.

2. Description of the Related Art

The methods for installing utility pole underbracing include construction by manual labor and mechanized methods using a backhoe or auger crane.

Of these, utility pole construction work using an auger crane can be said to be the most universal construction method. To take a look at this method, an auger crane is used to excavate to the insertion depth, which is about ⅙ of the total pole length depending on the length of the utility pole, not exceeding 2.5 m, and the utility pole is inserted and erected in the excavated pit. After that, in order to install a rectangular utility pole underbracing, construction is carried out in a sequence of processes of additional excavation by backhoe or manual labor to make insertion of a rectangular utility pole underbracing possible, installation of the rectangular utility pole underbracing, and backfilling of the pit.

The utility pole underbracing work including installation of the utility pole underbracing, earth work which is carried out in some cases and its execution process will be described in more detail.

First, as shown in FIG. 1A, an earth wire 101 is put into the inside of the utility pole 100, and with the earth wire 101 drawn out from the lower end portion of the utility pole 100, a pit 102 is excavated at the location where the utility pole 100 is to be erected. Next, the utility pole 100 stands upright with the earth wire 101 drawn out onto the ground surface to prevent it from going into the pit 102. At this time, the earthing resistance base value, kind of soil and site conditions are considered before deciding the construction method, excavation method, excavation area, and excavation length, etc.

With such conditions considered, an earthing copper rod 103 having an iron pin is struck and driven into the pit 102, as shown in FIG. 1B. To install the earthing copper rod 103 in series, after the first copper rod goes down to the floor of the excavated pit 102, the iron pin is drawn out and the earthing copper rod 103 is connected in series. Next, the iron pin is assembled to the end of the second earthing rod and struck again to drive it in.

Especially, when the second earthing copper rod goes down close to the excavation floor, the earthing resistance is measured. At this time, if the earthing resistance is below the specified value, the iron pin is drawn out, the lead terminal inserted, and then the earthing copper rod is struck to drive it in completely.

As for the method of installing earthing electrodes, series installation by the deep strike method is advantageous as shown in FIG. 1C. In the case of a reinforced concrete utility pole, the earthing copper rod 103 should not be in direct contact with the utility pole 100, and in the case of a steel pipe utility pole, the earthing copper rod 103 is to be earthed with a separation of 1.0 m or more. In the case of installing the earthing electrodes in parallel, it is preferable to install them with proper spacing between earthing electrodes according to site conditions.

After connecting and compressing the earthing wire 101 and the lead terminals of the earthing copper rod 103 by the earthing sleeve, the pit 102 is backfilled and tamped to complete utility pole construction work.

However, in the utility pole construction work as mentioned above, the earthing resistance base value, kind of soil, and site conditions, etc. should be considered for the method of setting the earthing resistance using earthing copper rods before carrying out the work. Besides, since there are too many variable factors depending on the earthing electrode installation method, excavation method, excavation area, and excavation length, etc., extensive and diverse review is necessary before work.

Especially if the measured earthing resistance is above the specified value, multiple earthing copper rods should be installed in parallel, and the ensuing increase in the scale of the excavation causes a lot of construction time and incurs a very large economic cost.

Moreover, the rectangular utility pole underbracing used in the aforementioned construction method is 1.2 m long, so a large area must be excavated in order to bury the underbracing in addition to the excavation done with the auger crane. Especially if two rectangular utility pole underbracings are to be installed in parallel or crossover, a large amount of the soil around the place where the utility pole is erected must be excavated.

Namely, even if utility pole construction work is done using an auger crane, the work cannot be finished until additional backhoe equipment or equivalent man power is used to bury the rectangular utility pole underbracing after erecting the utility pole. As a result, the quantity of construction becomes excessive due to complicated processes in utility pole underbracing construction, giving rise to a problem of taking a considerable amount of time for construction.

Accordingly, Korean Patent Application No. 2006-103273 filed by the present applicant discloses a construction method of rectangular utility pole underbracing which uses an extendable excavating unit for an auger crane that does not need additional excavation by dint of a 2-step bench cut by extension and reduction of an extendable excavating unit. According to this method, the excavation process is easy, the utility pole can be buried firmly with a small amount of earth during backfilling work, and work efficiency is increased.

In addition, relating to the aforementioned method, Korean Patent Application No. 2007-051211 filed by the present applicant discloses an excavation screw for an auger crane for mechanized excavation of burial holes for utility poles, or utility pole underbracing and guy wire underbracing. In the excavation screw of this patent, an extension rod is mounted such that it extends from the top of the excavation screw, oil inflow and discharge passages are formed inside the extension rod, and an extension unit having auxiliary excavating blades is combined to the bottom of the excavation screw. Inside the extension unit are formed main channels communicating with the oil inflow and discharge passages of the extension rod.

Since hydraulic pressure is also continuously acting on the auxiliary excavating blades of the lower extension unit corresponding to the varied excavation length of the extendable excavating screw, it is possible to properly use the extendable excavating screw with auxiliary excavating blades operated by hydraulic pressure according to the depth of excavation work. When using the extendable excavating screw with hydraulically extended auxiliary excavating blades, the construction period is shortened and workability is greatly improved.

In addition, Korean Patent Application No. 2006-0112100 filed by the present applicant discloses a semi-circular utility pole underbracing used in utility pole erection work. In this semi-circular utility pole underbracing, the earthing plate functioning as an earthing copper rod is monolithically attached to the utility pole underbracing in the course of carrying out the earthing work together with the utility pole erection work of overhead power transmission and distribution lines. In particular, friction-increasing concave slots and bolt inserting holes are formed on the outer surface of the utility pole underbracing, and the outer wall of the utility pole underbracing is semi-circular, and the inside surface has a utility pole gripping surface formed in an arch. For this semi-circular utility pole underbracing, an earthing plate of conductive metal material is made in a shape identical to the bottom surface of the semi-circular utility pole underbracing, and then the earthing plate is attached to the bottom surface of the utility pole underbracing, and an earthing terminal is formed on the outer surface of the earthing plate to connect the earthing plate and earthing terminal to each other. Therefore, without an additional excavation process for earthing work, earthing work is effectively carried out simultaneously with the utility pole underbracing mounting process, so the number of processes can be reduced innovatively, and the earthing effect is reliable and effective due to an increased earthing surface area.

And, Korean Patent Application No. 2007-0069477 filed by the present applicant discloses a hook for carriage and installation of a utility pole underbracing whereby the utility pole underbracing used in utility pole erection work for power distribution lines can be easily carried and installed. The hook for carriage and installation of this patent comprises a ring for hanging on the hook of the crane, a coupler positioned below the ring to level the utility pole underbracing, and a support for bearing the weight of the utility pole underbracing by combining the coupler and the utility pole underbracing. According to this patent, it is possible to hang the hook for carriage and installation on the crane, and the hook is easily fastened to the utility pole underbracing to easily move the utility pole underbracing to a desired position, and also since interference between the hook for carriage and installation and the utility pole underbracing is prevented, it is possible to mount the utility pole using a fastening means such as U bolt right away with the utility pole drawn near by the crane. Therefore, it is possible to quickly install with only one worker, and since the structure is relatively simple, it is possible to efficiently support and carry the utility pole underbracing, and since the utility pole underbracing is prevented from shaking or moving freely in transit, the work can be carried out very safely.

Meanwhile, Korean Patent Application No. 2007-009478 by the present applicant discloses a C-type utility pole underbracing with raised portions at both ends for construction of a utility pole. This patent relates to an arched utility pole underbracing supporting the lower end portion of a utility pole for firmly fixing the utility pole during utility pole erection and burial work. This arched utility pole underbracing has raised portions formed at both ends, and the arched rear portion of the underbracing has a smaller outer diameter than the front portion, and a hook inserting hole penetrates the central portion of the arched utility pole underbracing, and slit-shaped bolt combining holes are formed at a given interval on both sides of the inserting hole, so that mechanized work using the expander of an auger crane is possible during installation of the utility pole underbracing. Therefore, the grounding contact with the soil is improved through the raised portions at both ends, and also it is possible to aim at making the utility pole underbracing lightweight through the reduced rear portion. Also, transportation and installation of the utility pole underbracing is easy using a crane by dint of the hook inserting hole, and the U bolt can be easily fastened by dint of the bolt combining hole.

SUMMARY OF THE INVENTION

It is an object of the present invention to provide a method for installing an arch-type utility pole underbracing derived from the construction method for rectangular utility pole underbracing as described above. It is an object of the present invention to provide a method for installing an arch-type utility pole underbracing for an overhead line using an extendable excavating unit for an auger crane, whereby work efficiency is improved because it is possible to perform the excavation process easily by carrying out a 2-step bench cut by extension and retraction of an extendable excavating unit without use of additional man power or complicated additional processes, and also it is possible to bury the utility pole and arch-type utility pole underbracing firmly with a small amount of earth during backfilling work.

In accordance with the present invention, there is provided a method for installing an arch-type utility pole underbracing for an overhead line using an extendable excavating unit for an auger crane, which uses a utility pole to support the overhead line, an arch-type underbracing buried and fastened to the lower part of the utility pole, an underbracing hook for carrying and installing the utility pole underbracing, a U-bolt for fastening together the utility pole and the utility pole underbracing, an auger crane device for moving the utility pole and the utility pole underbracing, and an extendable excavating unit mounted on the auger crane.

According to the method for installing an arch-type utility pole underbracing for an overhead line using an extendable excavating unit for an auger crane of the present invention, systematic work processes and steps are carried out in sequence, so it is possible to carry out the erection work of the utility pole quickly and stably and also to install an arch-type utility pole underbracing securely, and earthing work is carried out easily by using an arch-type utility pole underbracing having an earthing function. And, since excavation of the burial hole is done easily and quickly without an additional manual excavation process or additional equipment by using an extendable excavating unit, it is possible to reduce the construction cost, improve the work site environmentally, and improve the construction quality as well as shorten the time required for construction.

DETAILED DESCRIPTION OF THE PREFERRED EMBODIMENT

Hereinafter, the construction devise and method for installing an arch-type underbracing according to a preferred embodiment of the present invention will be described in detail.

Figure 1A:
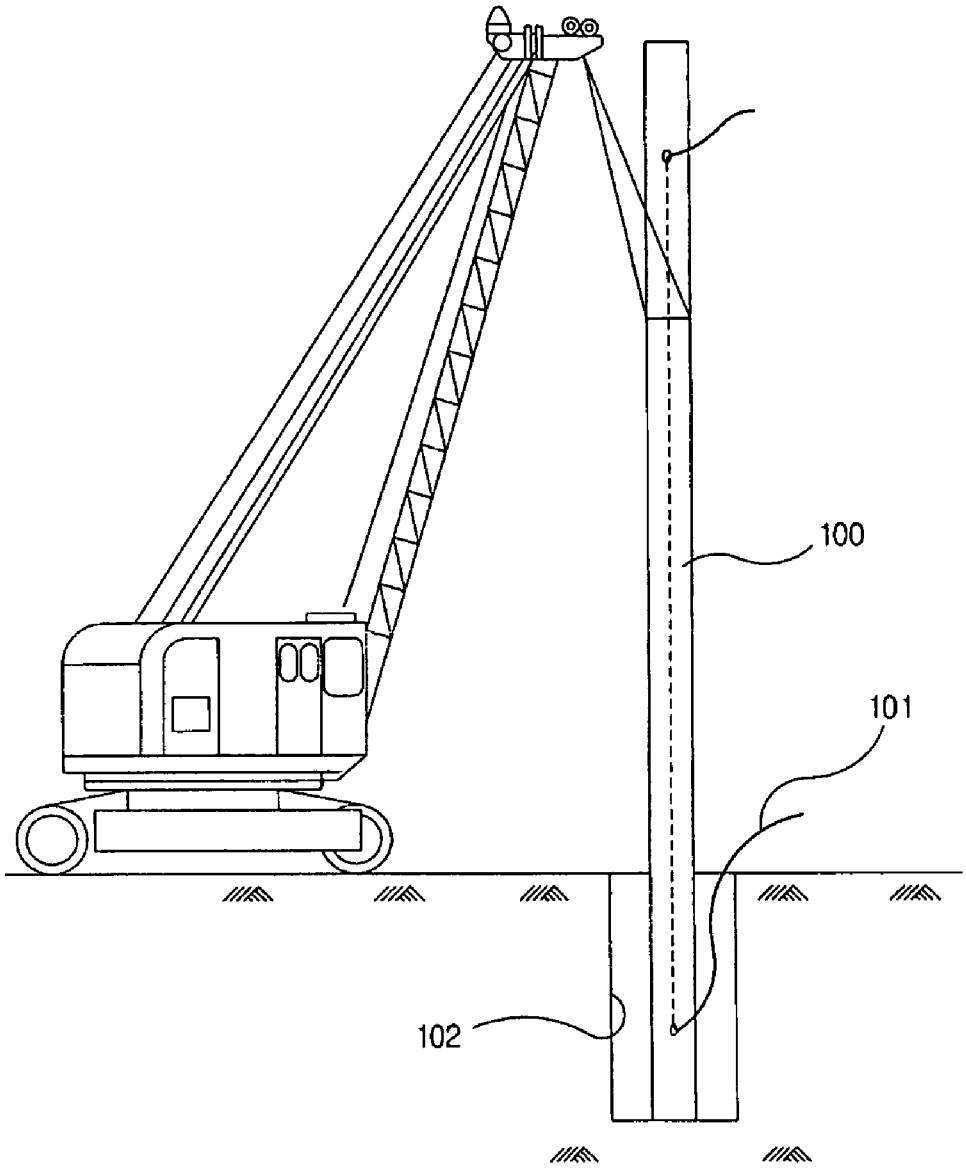
Fig. 1A (Prior Art)
FIG. 1A is a schematic view showing a conventional process of erecting a utility pole in an excavation hole.
Figure 1B:
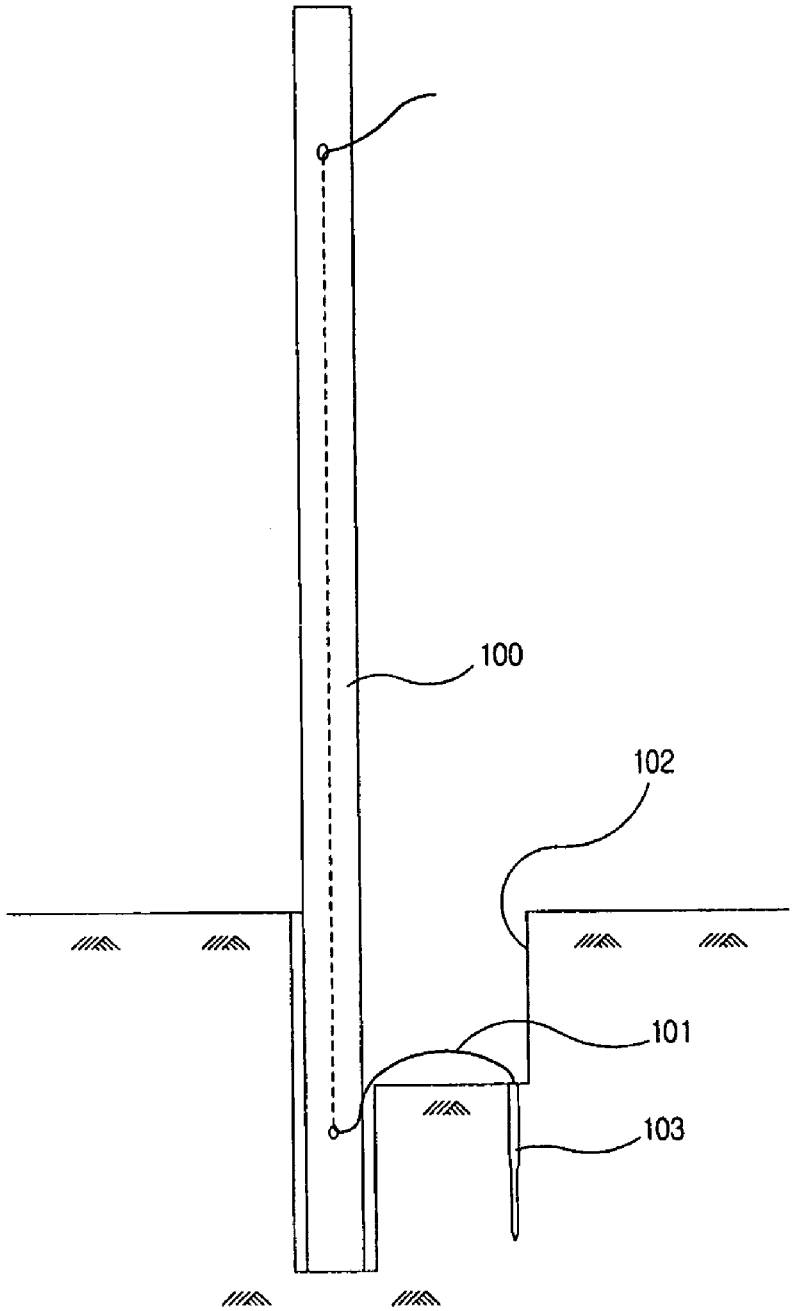
Fig. 1B (Prior Art)
FIG. 1B is a schematic view showing a conventional process of installing an earthing copper rod in the excavated part.
Figure 1C:
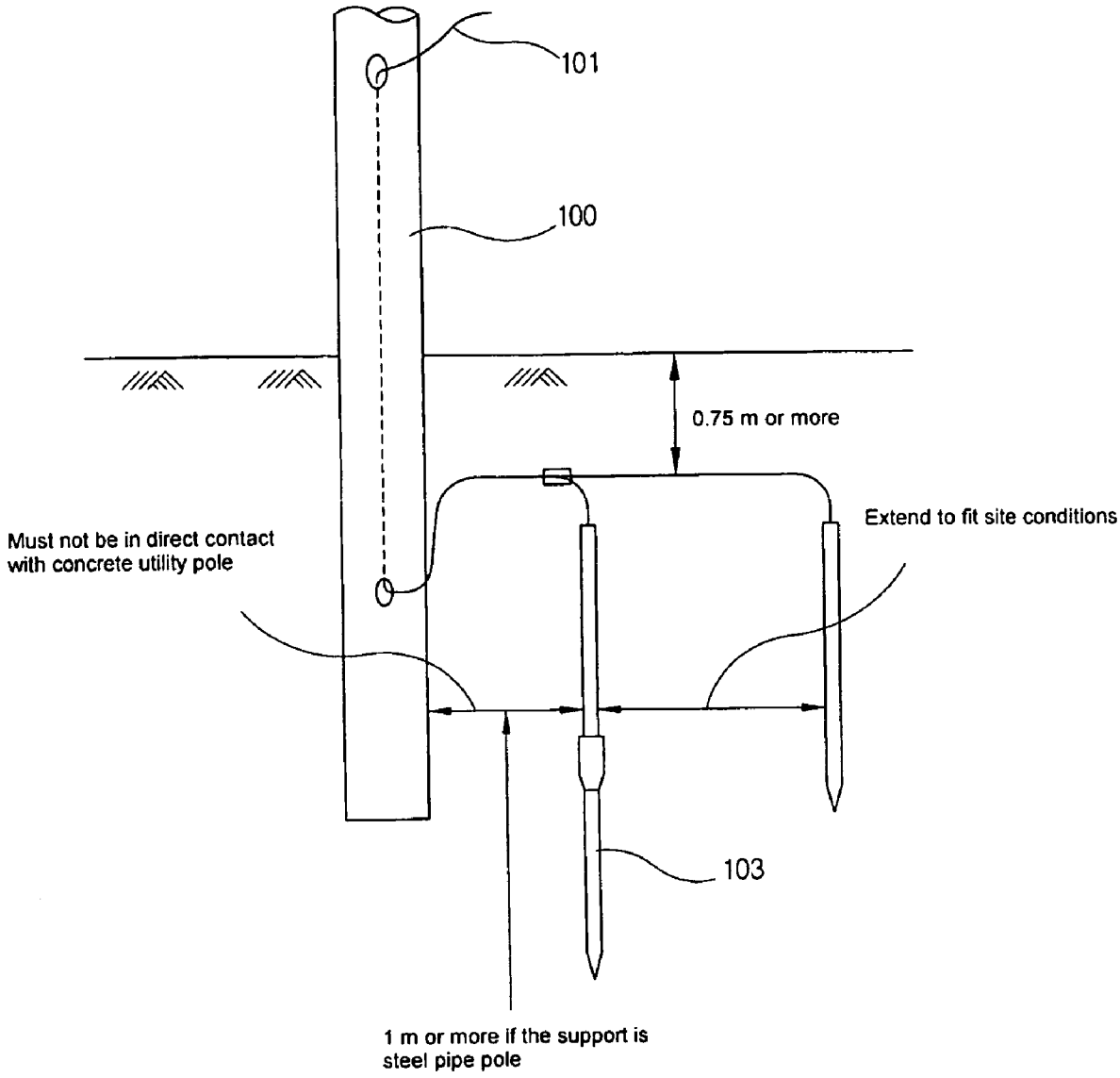
Fig. 1C (Prior Art)
FIG. 1C is a schematic view showing a conventional completion of utility pole erection work including earthing by an earthing copper rod.
Figure 2A:
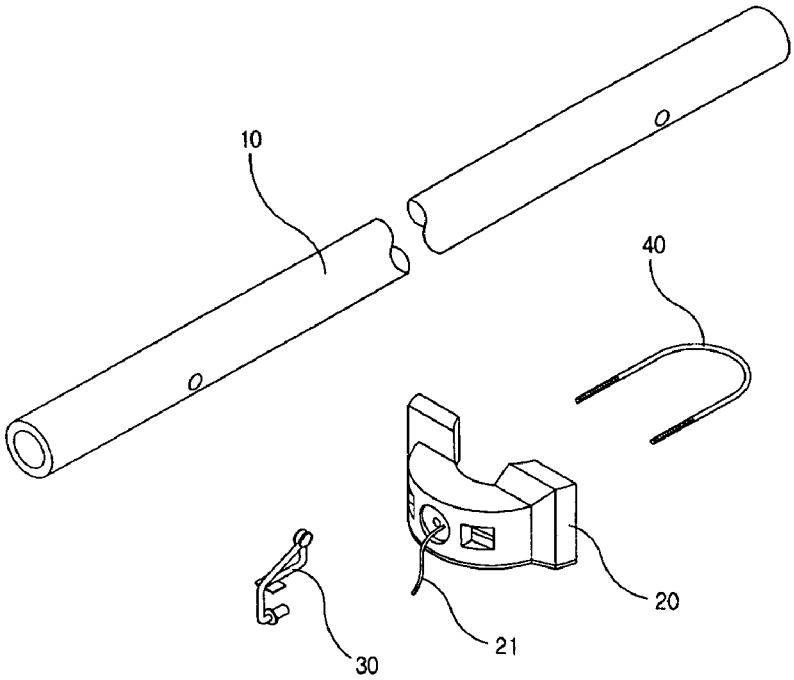
FIG. 2A is a perspective view showing the items prepared in the preparation work step of the present invention.

FIG. 2A is a perspective view showing the site preparation step. After arriving at the destination where utility pole erection work is to be carried out, the items for utility pole erection work are prepared, including a utility pole 10, an arch-type utility pole underbracing 20, an underbracing hook 30 and a U-bolt 40. At this time, it is obvious that excavation equipment of an auger crane 50 and excavation unit 60 accompany the above-mentioned items.

With the above preparation made, an excavation point for the utility pole is selected based on design criteria. In the process of selecting the excavation point like this, work for confirming whether things are buried underground must be performed.

Figure 2B:
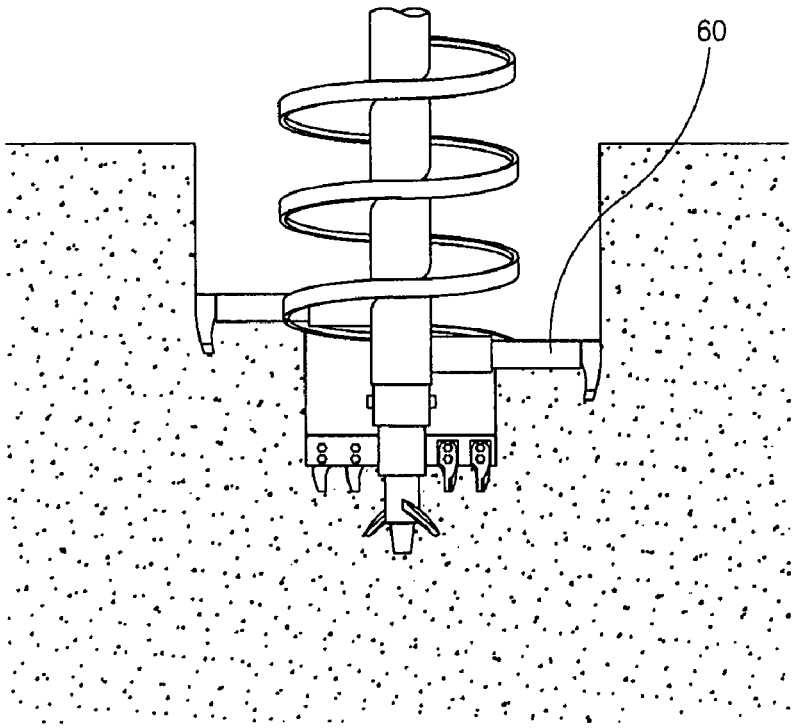
FIG. 2B is a sectional view showing the first excavation process using an extended excavation unit of the present invention.

FIG. 2B is a sectional view showing the first excavation step. First, with the excavation unit 60 extended and the excavation diameter adjusted to 80 cm, the first excavation work is carried out to a depth of 75 cm using the auger crane 50 and excavation unit 60. At this time, the excavation depth of 75 cm corresponds to the burial depth of the arch-type utility pole underbracing 20 fastened to the lower end of the utility pole.

Figure 2C:
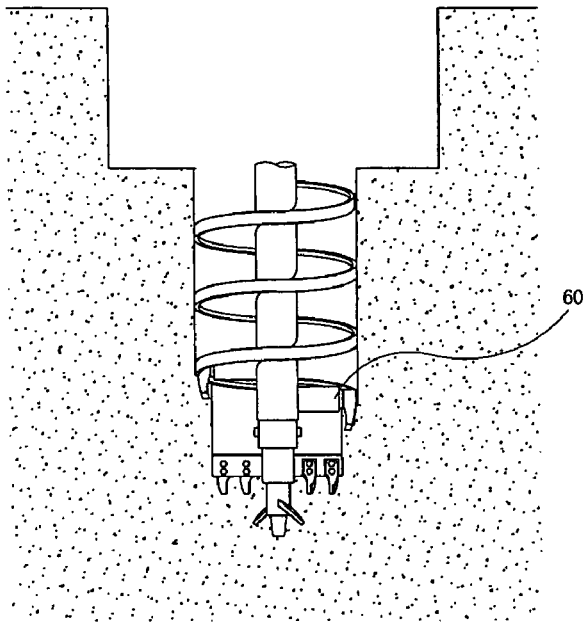
FIG. 2C is a sectional view showing the second excavation process using a restored excavation unit of the present invention.

FIG. 2C is a sectional view showing the second excavation step. After forming an excavated part 80 cm wide and 75 cm deep using extended excavation unit 60, the extended excavation unit 60 is retracted to its original basic shape, and the second excavation work is performed as far as the standard pole setting depth.

At this time, loose dirt generated during the second excavation work is deposited in the burial location of the arch-type utility pole underbracing, but this earth is used for backfilling the second excavated part, so it is not necessary to do extra disposal work. When the second excavation hole is formed, the utility pole erection work is performed in which the utility pole is erected according to standard procedures.

Figure 2D:
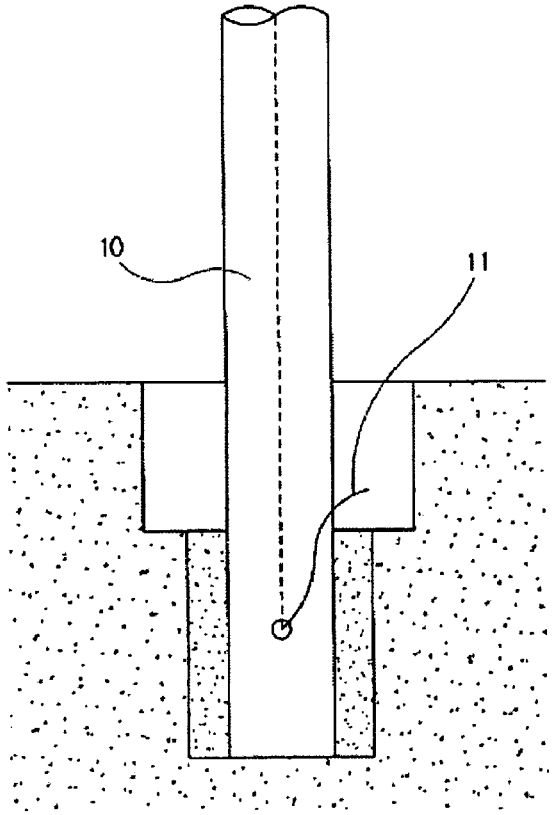
FIG. 2D is a sectional view showing the process of erecting the utility pole in the second excavation hole of the present invention.

FIG. 2D is a sectional view showing the process of backfilling the second excavated part after the utility pole has been erected, as well as the process of securing the burial space for the arch-type utility pole underbracing. To erect the utility pole 10 and backfill, the installation direction of the arch-type utility pole underbracing is determined, and then the second excavated portion is back filled with earth excavated by the expander while securing the burial space for the arch-type utility pole underbracing.

In other words, the first back fill process is carried out while preparing the burial space portion 80 cm wide and 75 cm deep in which the underbracing is to be buried. It is preferable to evenly tamp the floor side where the arch-type utility pole underbracing will be situated immediately after burial of the utility pole using fine soil in order to obtain more effective earthing resistance. At this time, draw out the earth wire 11 through a hole in the lower end portion of the utility pole 10.

Figure 2E:
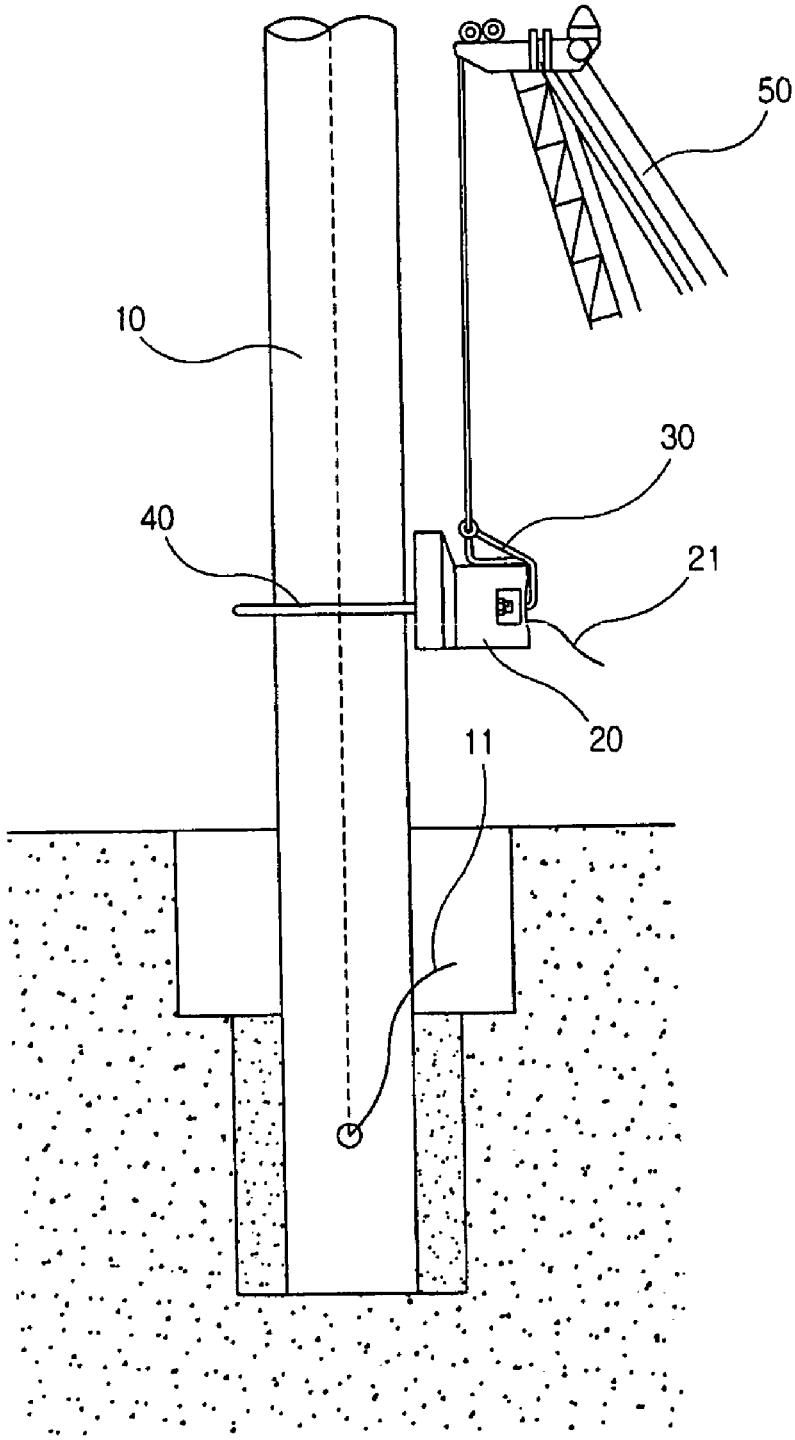
FIG. 2E is a perspective view showing the state of temporary attachment of an arch-type utility pole underbracing to the temporarily installed utility pole of the present invention.

FIG. 2E is a sectional view showing the process of temporarily attaching the arch-type utility pole underbracing to the utility pole. With the underbracing hook 30 hung on a separately provided arch-type utility pole underbracing 20, move the arch-type utility pole underbracing 20 to the installed location using auger crane 50.

Using the underbracing hook 30 in this condition, the utility pole 10 and arch-type utility pole underbracing 20 are temporarily assembled using a U-bolt 40 while the arch-type utility pole underbracing 20 is supported by the hook 30. At this time, the U-bolt 40 is lightly secured with enough force to let the arch-type utility pole underbracing 20 descend easily to the burial location while attached to the utility pole 10.

Figure 2F:
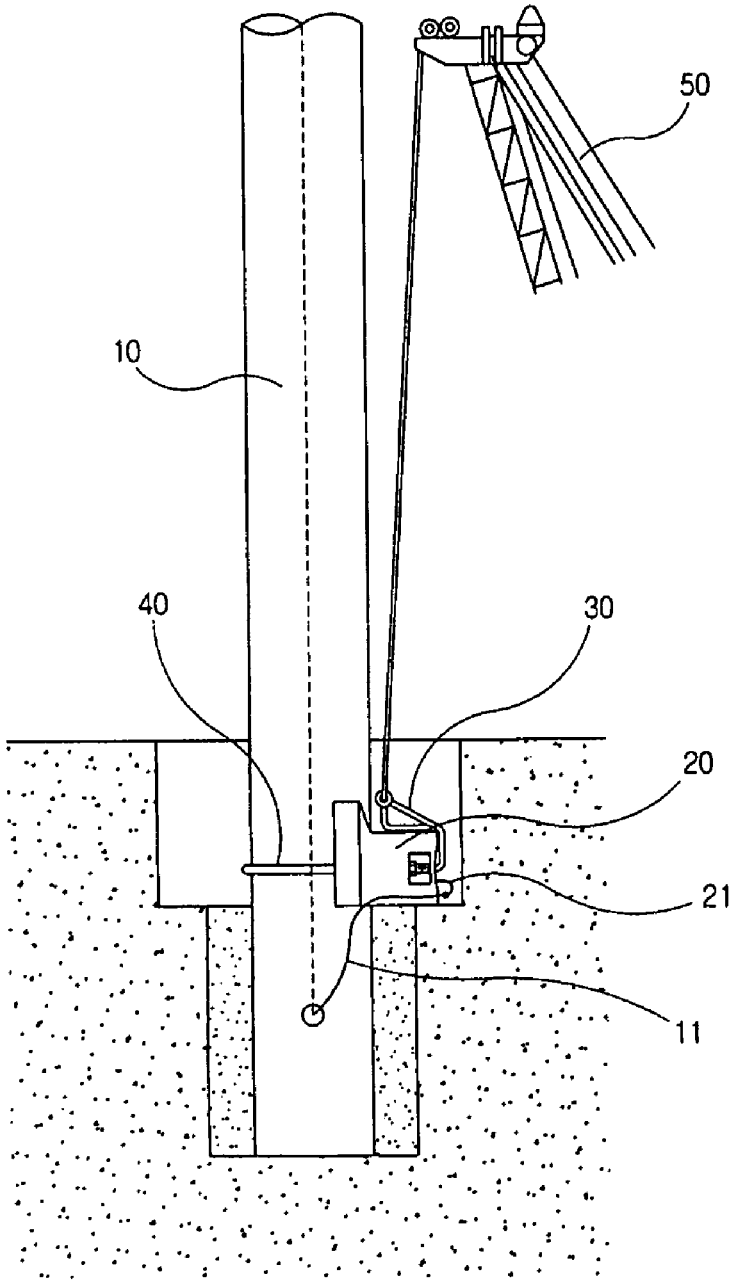
FIG. 2F is a sectional view showing the state in which the arch-type utility pole underbracing is placed in the burial space portion and is fastened to the utility pole of the present invention.

FIG. 2F is a sectional view showing the arrangement of the earth wire connection and the arch-type utility pole underbracing. With the arch-type utility pole underbracing 20 held up by the auger crane 50, the lead wire 21 is drawn out from the arch-type utility pole underbracing 20 and is connected to the earth wire 11 drawn out from the utility pole 10, and then the wire of the auger crane 50 is allowed to descend to position the arch-type utility pole underbracing 20 in the burial space portion. Then the underbracing hook 30 is removed and the U bolt 40 firmly tightened to temporarily fasten the utility pole 10 to the arch-type utility pole underbracing 20.

Figure 2G:
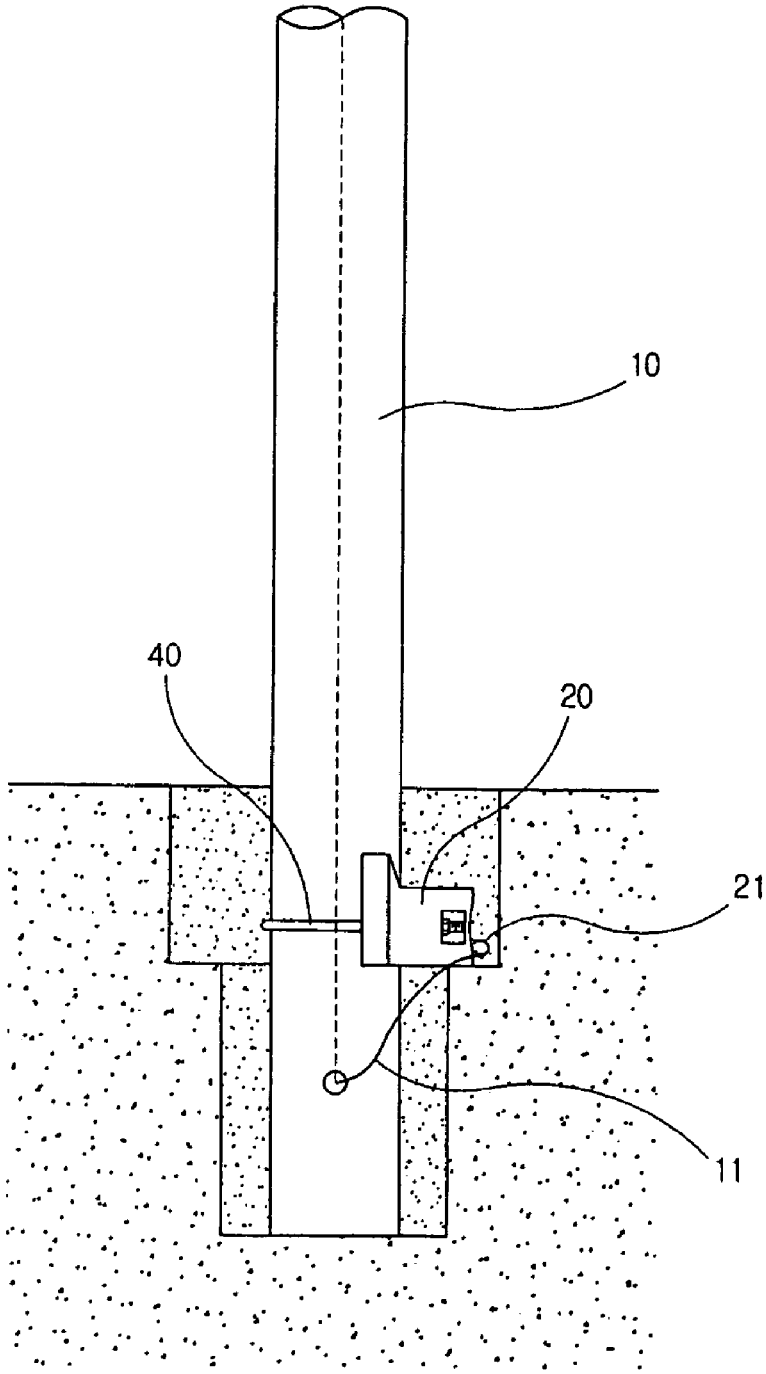
FIG. 2G is a sectional view showing the state of completion of the entire utility pole erection work of the present invention.

FIG. 2G is a sectional view showing the second backfilling step. As described above, with the arch-type utility pole underbracing 20 fastened to the utility pole 10, the underbracing burial space portion is backfilled using the soil nearby.

At this time, instead of backfilling the underbracing burial space portion all at once, it is preferable to make the ground firm by carrying out backfilling and soil compaction in regular sequence creating layers of 30 cm for the total depth of 75 cm. When the second backfilling process is completed, the surroundings are put in order and the utility pole erection work is complete.

Although the present invention has been described in detail with reference to its presently preferred embodiment, it will be understood by those skilled in the art that various modifications and equivalent substitutions can be made without departing from the spirit and scope of the present invention, as set forth in the appended claims.

What is claimed is:

1. A method for installing a utility pole and an arch-type underbracing by using an extendable excavating unit, which is mounted on an auger crane, the method comprising:

preparing said utility pole (10), said arch-type underbracing (20), an underbracing hook (30), a U bolt (40), a shovel, a benchmark rod, and a tamping rod at working site, selecting an excavating spot to erect the utility pole and install the arch-type underbracing (20), inspecting underground of the excavating spot whether there are any underground structures buried before excavating the ground, and verifying the excavating spot determined based on the benchmark of the utility pole, excavating the spot for a primary hole about 75 cm in depth by extending an arm about 80 cm diameter of the extendable excavation unit mounted on the auger crane, retracting the extended arm of the extended excavation unit to its original state of a standard diameter after excavating the primary hole, excavating the spot for a secondary hole to have a standard depth for erecting the utility pole, erecting the utility pole according to the standard manual of utility pole erection procedures, determining an orientation of the arch-type underbracing, and preparing a burial area for setting the arch-type underbracing on the primary hole of about 80 cm diameter and about 75 cm deep, securing the erected utility pole and filling the excavated soils back into gaps around the utility pole and the secondary hole, installing an underbracing hook to the arch-type underbracing, then lifting the arch-type underbracing to the utility pole by the auger crane, attaching a U-bolt temporarily to the arch-type underbracing by surround the utility pole while the arch-type underbracing is suspended at middle of the utility pole by the auger crane, connecting a lead wire of the arch-type underbracing to an earth wire of the utility pole, descending and positioning the arch-type underbracing on floor of the burial area of the primary hole by the auger crane, tightening the assembly of the arch-type underbracing and the U-bolt being surrounded the utility pole after removing the underbracing hook, filling the excavated soils back into gaps around the utility pole and the primary hole by tamping 30 cm soil layer intervals for the excavated depth of 75 cm, and finishing the works by grounding the surrounding of the utility pole construction site.

* * * * *